US007611260B1

(12) United States Patent
Lin et al.

(10) Patent No.: US 7,611,260 B1
(45) Date of Patent: Nov. 3, 2009

(54) PROTECTING COVER AND LED LAMP TUBE HAVING THE SAME

(75) Inventors: Kuo-Len Lin, Wugu Township, Taipei County (TW); Chen-Hsiang Lin, Wugu Township, Taipei County (TW); Ken Hsu, Wugu Township, Taipei County (TW); Chih-Hung Cheng, Wugu Township, Taipei County (TW)

(73) Assignees: Cpumate Inc., Taipei (TW); Golden Sun News Techniques Co., Ltd., Taipei (TW)

( * ) Notice: Subject to any disclaimer, the term of this patent is extended or adjusted under 35 U.S.C. 154(b) by 12 days.

(21) Appl. No.: 12/166,586

(22) Filed: Jul. 2, 2008

(51) Int. Cl.
*F21S 4/00* (2006.01)

(52) U.S. Cl. ..... 362/224; 362/217; 362/218; 362/223

(58) Field of Classification Search ..... 362/311.14, 362/217, 218, 223, 224, 800, 294, 396; 313/634, 313/493, 238
See application file for complete search history.

(56) References Cited

U.S. PATENT DOCUMENTS

| | | | | |
|---|---|---|---|---|
| 4,393,323 | A * | 7/1983 | Hubner | 313/110 |
| 6,078,136 | A * | 6/2000 | Sica | 313/493 |
| 6,472,823 | B2 * | 10/2002 | Yen | 315/112 |
| 6,882,111 | B2 * | 4/2005 | Kan et al. | 315/122 |
| 7,114,830 | B2 * | 10/2006 | Robertson et al. | 362/240 |

* cited by examiner

*Primary Examiner*—Jacob Y Choi
(74) *Attorney, Agent, or Firm*—Chun-Ming Shih

(57) ABSTRACT

A light emitting diode (LED) lamp tube structure includes a tube, a circuit board, a plurality of LED lamps, two electric connectors and a protecting cover. The tube includes a plurality of heat dissipating holes. The circuit board is installed in the tube. The LED lamps are installed on the circuit board and electrically coupled to the circuit board. The two electric connectors are connected to both ends of the tube and electrically coupled to the circuit board. The protecting cover is installed onto the LED lamp tube and includes a board, and through holes disposed on the board and corresponding to the heat dissipating holes. Therefore, the LED lamp tube structure achieves a good heat dissipating effect and enhances the life of the LED lamp tube.

7 Claims, 6 Drawing Sheets

PROTECTING COVER AND LED LAMP TUBE HAVING THE SAME

BACKGROUND OF THE INVENTION

1. Field of the Invention

The present invention generally relates to a light emitting diode (LED) lamp tube, and more particularly to a protecting cover and an LED lamp tube having the protecting cover.

2. Description of Prior Art

As science and technology advance, electronic products and components tend to be developed with a thin, light, short and compact design, and electronic components such as light emitting diodes (LEDs) are used extensively in illumination equipments due to the advantages of small size, power saving, long life and environmental protection, etc. Although the light emitting diode has encountered a bottleneck of insufficient brightness at an early stage of its development, breakthroughs on related materials and technologies have been made in recent years, and the light emission efficiency of the light emitting diode is improved substantially even up to the brightness of traditional illumination equipments. Therefore, LED lamp tubes gradually substitute the present illumination equipments.

In general, a conventional LED lamp tube includes a tube, a circuit board, a plurality of LED lamps and two electric connectors. The tube is substantially transparent, and the circuit board and the plurality of LED lamps are installed in the tube. The two electric connectors are coupled to both ends of the tube and electrically coupled to the circuit board, and the tube includes a plurality of heat dissipating holes having a rectangular cross section, and the heat dissipating holes are disposed at an upper side of the circuit board, and the LED lamps are disposed at a lower side of the circuit board and electrically coupled to the circuit board, so as to form the LED lamp tube.

However, the conventional LED lamp tube still has the following drawbacks. Since hot air is produced inside the LED lamp tube and dissipated to the outside through the heat dissipating holes, therefore the air flow speed of the hot air cannot be increased effectively when the hot air passes through the heat dissipating holes, and thus affecting the heat dissipating performance of the LED lamp tube. Furthermore, bugs such as mosquitoes and flies may enter into the tube directly through the heat dissipating holes and stay on the circuit board, and thus affecting the appearance of the LED lamp tube and reducing the performance and life of the LED lamp tube.

In view of the shortcomings of the prior art, the inventor of the present invention based on years of experience in the related industry to conduct extensive researches and experiments, and finally developed a protecting cover and a light emitting diode lamp tube having the protecting cover in accordance with the present invention.

SUMMARY OF THE INVENTION

It is a primary objective of the invention to overcome the shortcomings of the prior art by providing a protecting cover and an LED lamp tube having the protecting cover, wherein a through hole of the protecting cover has an internal diameter smaller than that of a heat dissipating hole of the tube, and hot air produced in the tube is passed through the heat dissipating holes and the through holes, and accelerated and discharged to the outside, so as to enhance the heat dissipating speed of the LED lamp tube for a good heat dissipating effect.

Another objective of the present invention is to provide a protecting cover and an LED lamp tube having the protecting cover, wherein a plurality of through holes of the protecting cover have an internal diameter smaller than the size of a bug for preventing bugs from entering into a tube directly through the heat dissipating holes of the tube or staying on the circuit board, which will affect the appearance of the LED lamp tube and reduce the performance and life of the LED lamp tube of the invention. Therefore, the present invention not only maintains the appearance of the LED lamp tube, but also improves the life of the LED lamp tube.

A further objective of the present invention is to provide a protecting cover and an LED lamp tube having the protecting cover, wherein a plurality of clamping plates of a board are provided for elastically clamping the protecting cover onto a tube to facilitate a quick and simple assembling process and save the assembling time.

Therefore, the present invention provides an LED lamp tube comprising a tube, a circuit board, a plurality of LED lamps, two electric connectors and a protecting cover. The tube includes a plurality of heat dissipating holes, and the circuit board is installed in the tube, and the LED lamps are installed on the circuit board and electrically coupled to the circuit board, and the two electric connectors are connected to both ends of the tube respectively and electrically coupled to the circuit board. The protecting cover is installed onto the LED lamp tube, and the protecting cover includes a board, and a plurality of through holes disposed on the board and installed corresponding to the through holes.

The present invention further provides a protecting cover installed onto an LED lamp tube, and the LED lamp tube includes a tube and a plurality of heat dissipating holes disposed on the tube, and the protecting cover includes a board, and a plurality of through holes disposed on the board and installed corresponding to the heat dissipating holes respectively.

DETAILED DESCRIPTION OF THE INVENTION

The technical characteristics, features and advantages of the present invention will become apparent in the following detailed description of preferred embodiments with reference to the accompanying drawings, and the preferred embodiments are used for illustrating the present invention only, but not intended to limit the scope of the present invention.

Figure 1:
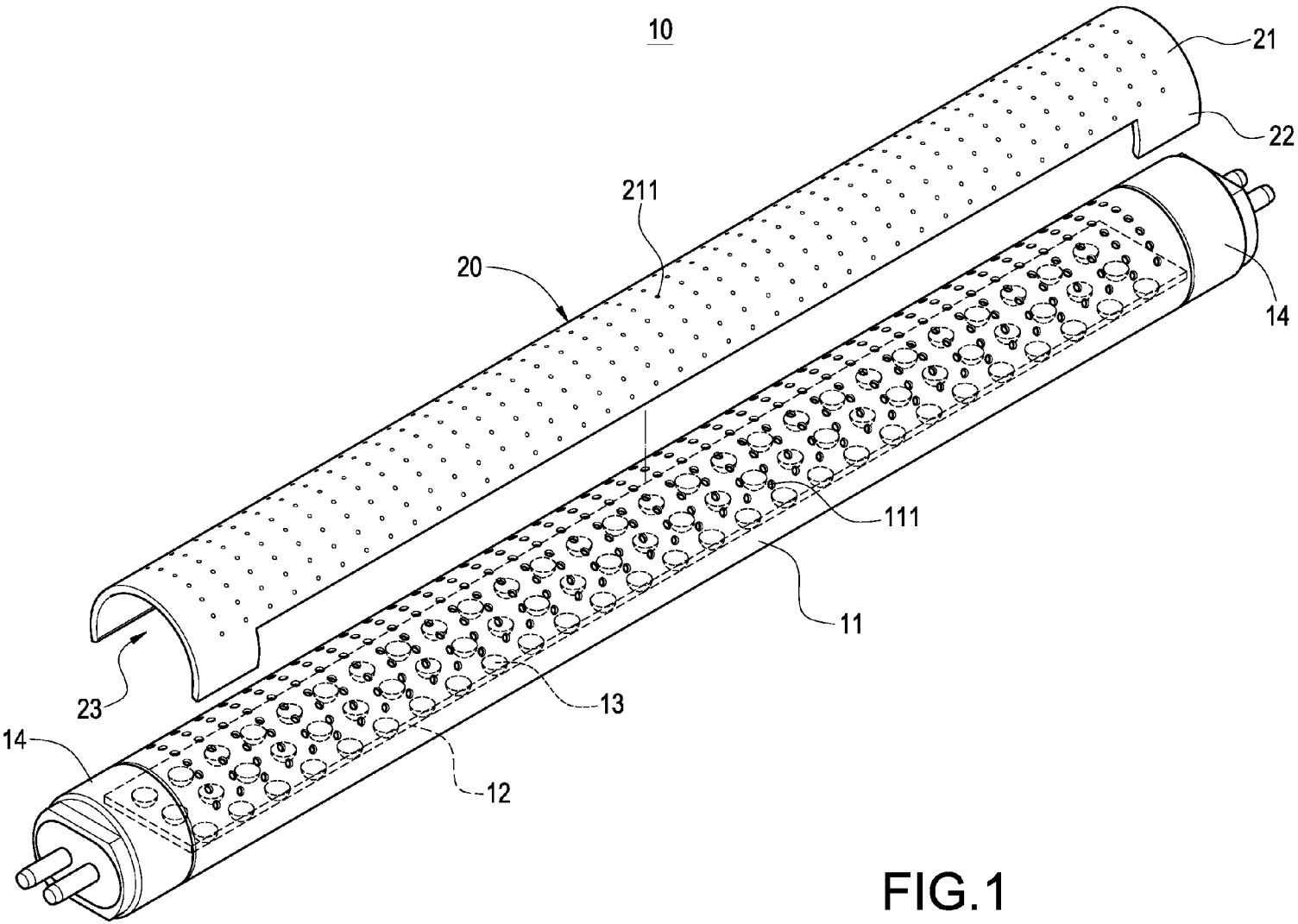
FIG. 1 is an exploded view of the present invention.
Figure 2:
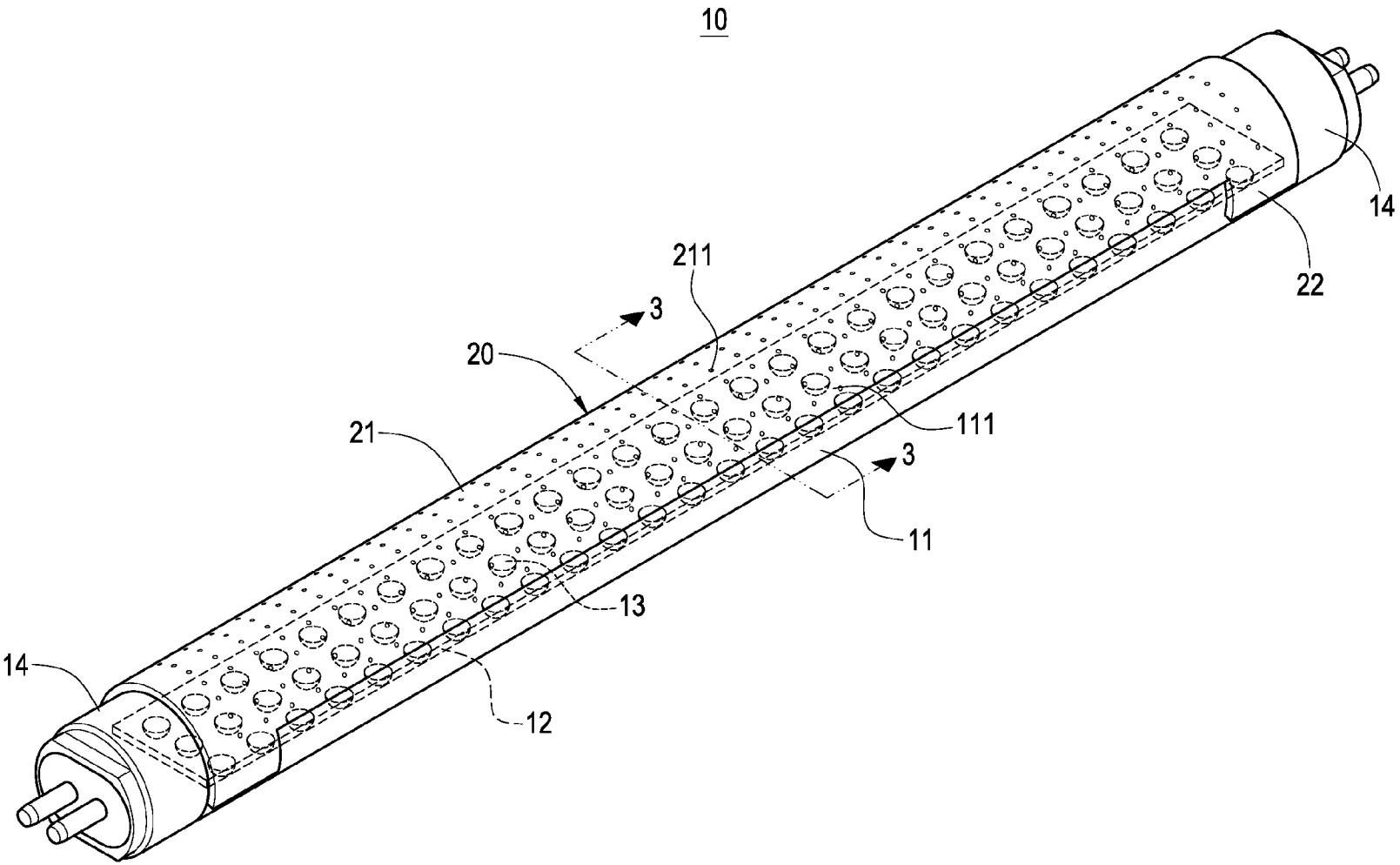
FIG. 2 is a perspective view of the present invention.
Figure 3:
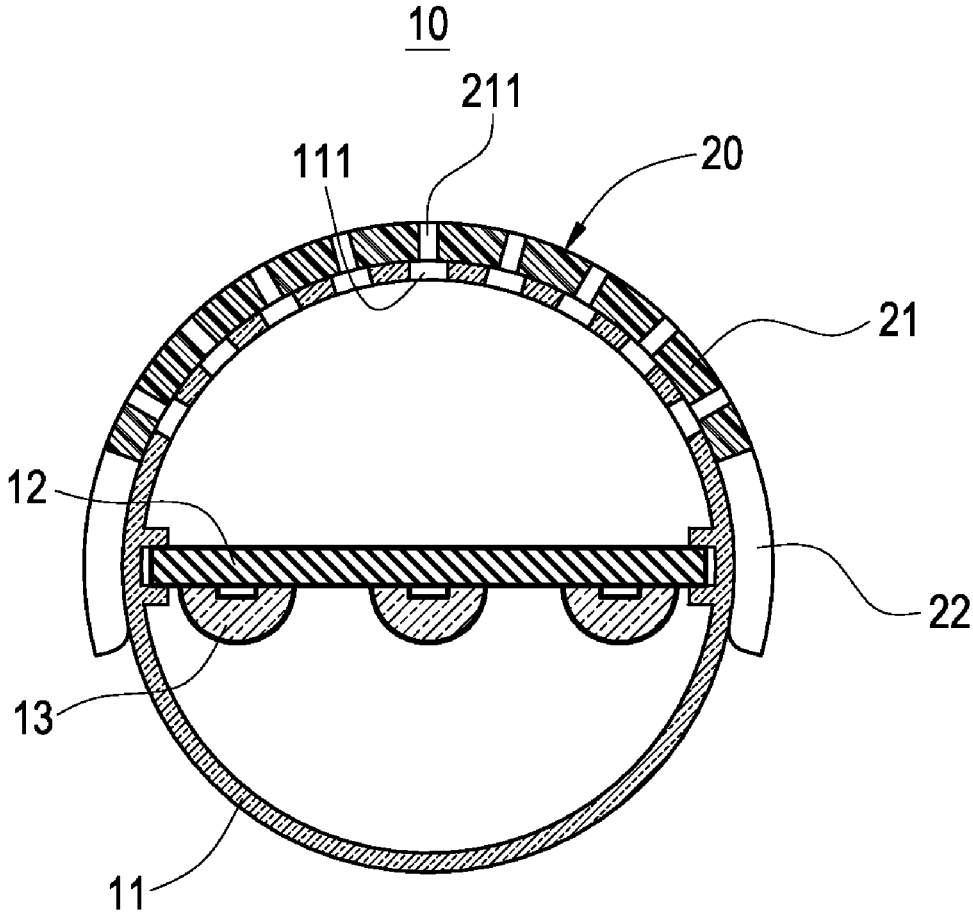
FIG. 3 is a cross-sectional view of Section 3-3 of FIG. 2.

With reference to FIGS. 1 to 3 for an LED lamp tube 10 in accordance with the present invention, the LED lamp tube 10 comprises a tube 11, a circuit board 12, a plurality of LED lamps 13, two electric connectors 14 and a protecting cover 20.

The tube 11 is made of a thin and transparent acrylic material, and the tube 11 includes a plurality of heat dissipating holes 111 arranged with an interval apart from each other.

The circuit board 12 is installed in the tube 11.

The LED lamps 13 are installed on the circuit board 12 and electrically coupled to the circuit board 12, and the LED lamps 13 are arranged with an interval apart from each other. The LED lamp 13 includes but not limited to a white-light LED lamp, a yellow-light LED lamp, a red-light LED lamp or a blue-light LED lamp.

The two electric connectors 14 are connected to both ends of the tube 11 respectively and electrically coupled to the circuit board 12.

The protecting cover 20 is installed onto the LED lamp tube 10, and the protecting cover 20 includes an arc board 21, a plurality of through holes 211 disposed on the board 21 and installed corresponding to the heat dissipating holes 111, two clamping plates 22 extended from both ends of the board 21 respectively, and a containing area 23 defined between the clamping plates 22 for containing the tube 11 which is elastically clamped by the clamping plates 22, wherein the through hole 211 has an internal diameter smaller than the internal diameter of the heat dissipating hole 111, and the internal diameter of the through hole 211 is preferably equal to 0.3 mm, and the internal diameter of the heat dissipating hole 111 is preferably equal to 0.5 mm. Further, the clamping plates 22 are clamped elastically onto the tube 11 and designed longer than the board 21 for elastically clamping the clamping plates 22 onto the two electric connectors 14.

With reference to FIGS. 2 and 3 for the assembling process of the present invention, the board 21 is elastically pressed after the containing area 23 of the board 21 is aligned with the tube 11, so that the tube 11 is contained in the containing area 23 and elastically clamped by the clamping plates 22, and then the through holes 211 are adjusted to align with the heat dissipating holes 111 to complete the assembling operation. Therefore, the present invention can achieve a quick, simple and convenient assembling process and save the assembling time.

Figure 4:
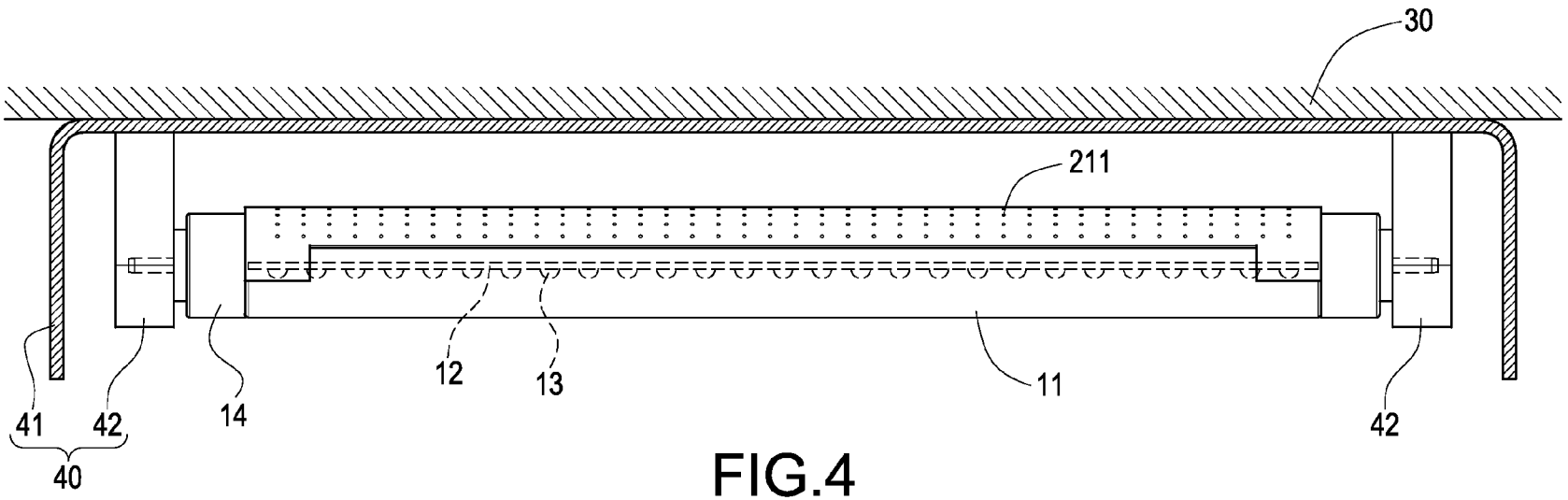
FIG. 4 is a schematic view of an application in accordance with the present invention.
Figure 5:
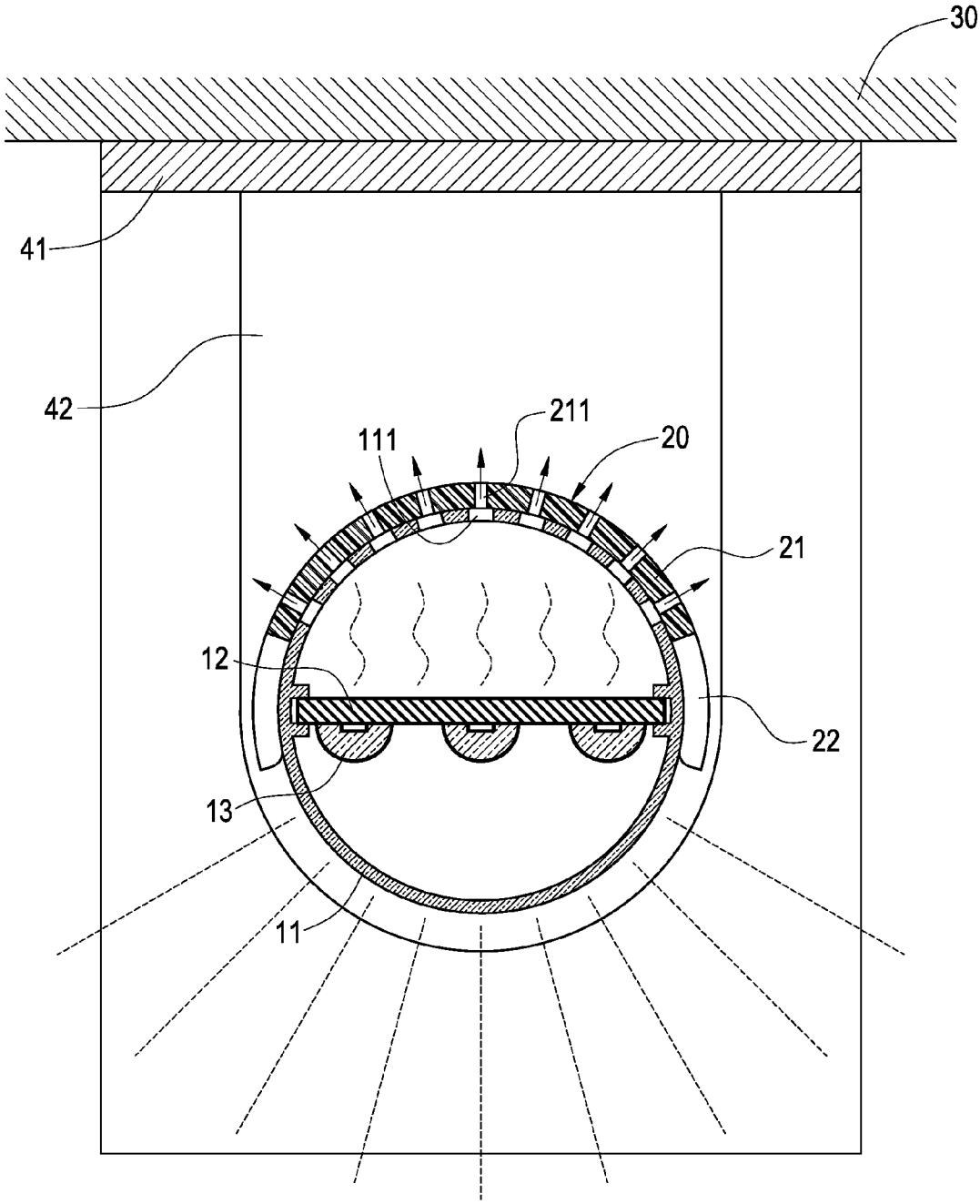
FIG. 5 is another schematic view of an application in accordance with the present invention.

With reference to FIGS. 4 and 5 for the use of the present invention, the assembled LED lamp tube is installed in a lamp holder 40 which is fixed to a ceiling 30, and the lamp holder 40 includes a lampshade 41 and two electric sockets 42 disposed in the lampshade 41 and electrically coupled to a power source. The two electric connectors 14 are plugged into the two electric sockets 42 respectively, and the LED lamps 13 will generate heat and emit light. The hot air produced when using the LED lamp tube is discharged to the outside through the heat dissipating holes 111 and the through holes 211. Since the internal diameter of the through hole 211 is smaller than the internal diameter of the heat dissipating hole 111, therefore the hot air is accelerated when the hot air is passed through the heat dissipating holes 111 and the through holes 211, and thus the present invention can enhance the heat dissipating speed of the LED lamp tube 10 and achieve a good heat dissipating effect.

Further, the internal diameter of the through holes 211 of the protecting cover 20 is designed smaller than the size of a general bug for preventing bugs from entering into the tube 11 directly through the heat dissipating holes 111 and staying on the circuit board 12, which will affect the appearance of the LED lamp tube of the present invention (since the tube 11 is transparent), and reduce the performance and life of the present invention. Therefore, the design of the protecting cover 20 can maintain the aesthetic appearance of the LED lamp tube 10 and enhance the life of the LED lamp tube.

Figure 6:
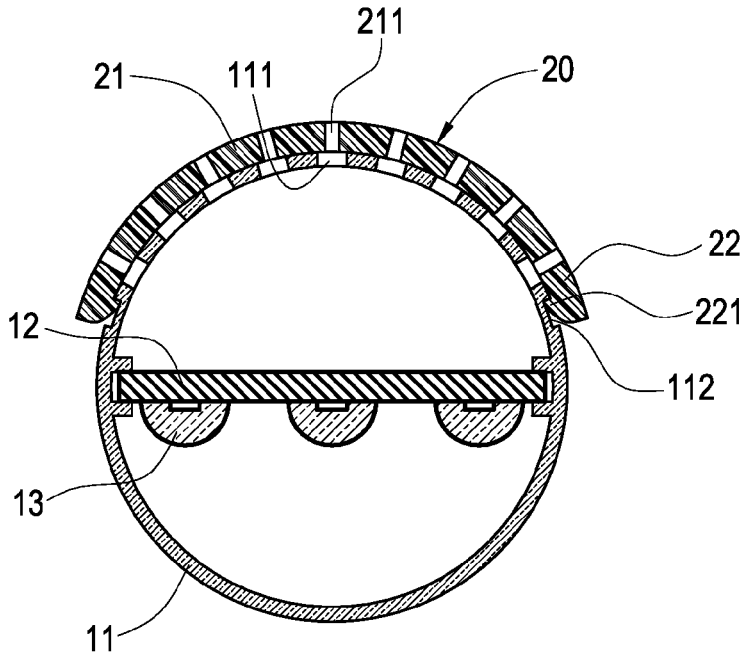
FIG. 6 is a schematic view of another preferred embodiment of the present invention.

With reference to FIG. 6 for another preferred embodiment of the invention, the difference of this preferred embodiment from the aforementioned preferred embodiment resides on that a hook 221 is formed on an internal side of the clamping plate 22, and a plurality of latch slots 112 are formed on a wall of the tube 11 and latched with the corresponding hooks 221 respectively, and thus the protecting cover 20 can be installed onto the tube 11 quickly to save the time of adjusting the alignment of the through holes 211 with the heat dissipating holes 111, and thus this preferred embodiment has the same effect as the foregoing preferred embodiment.

Figure 7:
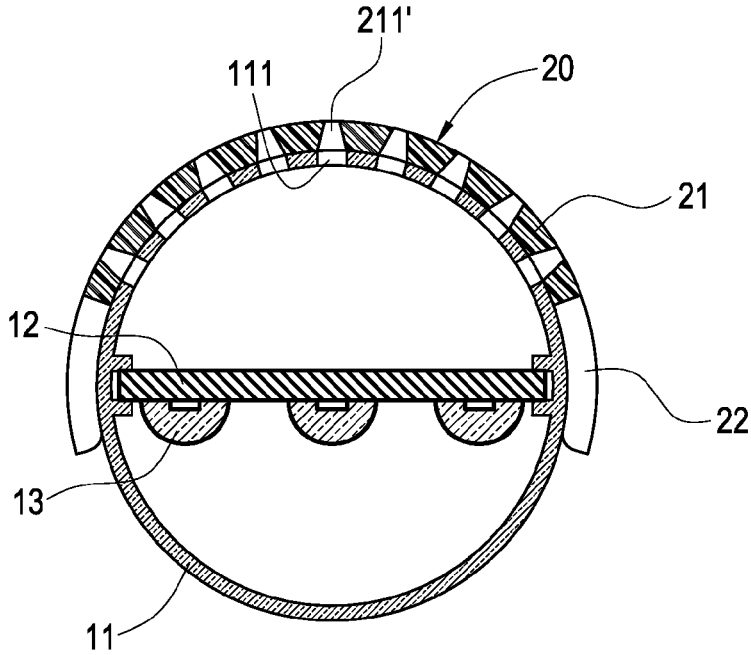
FIG. 7 is a schematic view of a further preferred embodiment of the present invention.

With reference to FIG. 7 for a further preferred embodiment of the invention, the difference of this preferred embodiment from the aforementioned preferred embodiment resides on that the through hole 211' comes with a conical cross section, such that when the hot air is passed through the heat dissipating holes 111 and the through holes 211', the hot air is accelerated, and this preferred embodiment has the same effect as the foregoing preferred embodiment.

In summation of the description above, the LED lamp tube in accordance with the present invention enhances the life and achieves a better heat dissipating effect while maintaining the appearance of the LED lamp tube and complies with the patent application requirements and thus is duly filed for patent application.

While the invention is described in by way of examples and in terms of preferred embodiments, it is to be understood that the invention is not limited thereto. On the contrary, the aim is to cover all modifications, alternatives and equivalents falling within the spirit and scope of the invention as defined by the appended claims.

What is claimed is:

1. A light emitting diode (LED) lamp tube structure, comprising: a tube, having a plurality of heat dissipating holes; a circuit board, installed in the tube; a plurality of LED lamps, installed on the circuit board, and electrically coupled to the circuit board; two electric connectors, coupled to both ends of the tube, and electrically coupled to the circuit board; and a protecting cover, partially enveloped onto the tube, and having an arc board, and a plurality of through holes being disposed on the board and installed aligning to the heat dissipating holes.

2. The LED lamp tube structure of claim 1, wherein the LED lamps are installed with an interval apart from each other and the heat dissipating holes are disposed with an interval apart from each other.

3. The LED lamp tube structure of claim 1, wherein the board is an elastic arc board.

4. The LED lamp tube structure of claim 1, wherein the board includes two clamping plate extended from both ends of the board respectively and elastically clamped onto the tube.

5. The LED lamp tube structure of claim 4, wherein each of the clamping plate includes a hook formed on an internal side of the clamping plate, and the tube includes a plurality of latch slots formed on a wall of the tube for latching the corresponding hooks respectively.

6. The LED lamp tube structure of claim 1, wherein the through hole has an internal diameter smaller than the internal diameter of the heat dissipating hole.

7. The LED lamp tube structure of claim 1, wherein the through hole has a conical cross section.

* * * * *